US011725377B1

(12) United States Patent
Miley

(10) Patent No.: US 11,725,377 B1
(45) Date of Patent: Aug. 15, 2023

(54) APPARATUS AND METHOD FOR A CYCLE SIPHON USING A FLOAT OPERATED MAGNETICALLY CONTROLLING PIVOTING FLOAT VALVE FOR MINIMIZING THE BUILD-UP OF GASES

(71) Applicant: Bradford A. Miley, Quakertown, PA (US)

(72) Inventor: Bradford A. Miley, Quakertown, PA (US)

( * ) Notice: Subject to any disclaimer, the term of this patent is extended or adjusted under 35 U.S.C. 154(b) by 0 days.

(21) Appl. No.: 17/581,318

(22) Filed: Jan. 21, 2022

(51) Int. Cl.
*E03F 5/04* (2006.01)
*F04F 10/00* (2006.01)

(52) U.S. Cl.
CPC ..... *E03F 5/0407* (2013.01); *E03F 5/041* (2013.01); *E03F 2005/0417* (2013.01); *F04F 10/00* (2013.01); *Y10T 137/2911* (2015.04)

(58) Field of Classification Search
CPC . E03F 5/0407; E03F 5/041; E03F 2005/0417; F04F 10/00; F04F 10/02; F16K 21/185; F16K 31/26; F16K 31/265; Y10T 137/7394; Y10T 137/7319; Y10T 137/7361; Y10T 137/2911; Y10T 137/6004; Y10T 137/053; G05D 9/02
USPC .... 137/909, 218, 123–153, 87.01–87.6, 122, 137/192–196, 202, 315.08, 386–454, 578, 137/15.26, 397, 410, 420, 135, 151, 137/123–153
See application file for complete search history.

(56) References Cited

U.S. PATENT DOCUMENTS 2,850,686 A 9/1958 Macgeorge
3,279,494 A 10/1966 Nixon
4,195,673 A 4/1980 Johnston et al.
4,328,596 A 5/1982 Renz
4,585,027 A 4/1986 Stillions
4,651,309 A 3/1987 Honda
4,865,588 A 9/1989 Flinchbaugh
4,924,862 A 5/1990 Levinson
(Continued)

FOREIGN PATENT DOCUMENTS

CN 208123477 U 11/2018

OTHER PUBLICATIONS

English abstract of CN208123477U, Nov. 2018.
(Continued)

*Primary Examiner* — Craig J Price
(74) *Attorney, Agent, or Firm* — Caesar Rivise, PC

(57) ABSTRACT

An apparatus and method for an intake-end siphon flow regulator that allows for continuous operation in container liquids with entrained gases. A float actuated valve opens and closes as needed so that the siphon draws in container liquid. The float valve mechanism uses magnets that provide for a continuous valve cycling. This cycling overcomes gas build up that typically causes the siphon to fail. By disallowing extended periods of relatively low flow and pressure, the siphon builds up less gas bubbles that obstruct siphon operation. When the liquid rises enough, the float's buoyancy overcomes the magnetic attraction and the valve completely opens. The highest flow possible occurs and washes gases downstream. As the container liquid draws down, the magnets draw closer and when their magnetic fields interact, the magnets are drawn together, completely closing the valve. As liquid again enters the container, the aforementioned cycle repeats.

8 Claims, 11 Drawing Sheets

(56) References Cited

U.S. PATENT DOCUMENTS

| | | | | |
|---|---|---|---|---|
| 4,984,549 | A | 1/1991 | Mesenich | |
| 5,007,420 | A | 4/1991 | Bird | |
| 5,035,535 | A | 7/1991 | Gress | |
| 5,080,126 | A | 1/1992 | De Rycke et al. | |
| 5,114,412 | A | 5/1992 | Flinchbaugh | |
| 5,342,025 | A | 8/1994 | Hwang | |
| 5,495,890 | A | 3/1996 | Edwards et al. | |
| 5,524,297 | A | 6/1996 | Harrison | |
| 6,032,832 | A | 3/2000 | Dority et al. | |
| 6,263,520 | B1 | 7/2001 | Song | |
| 6,514,047 | B2 | 2/2003 | Burr et al. | |
| 6,618,864 | B2 | 9/2003 | Veal | |
| 6,742,194 | B2 | 6/2004 | Shim | |
| 7,032,257 | B2 | 4/2006 | Chen | |
| 7,806,664 | B2 | 10/2010 | Patel et al. | |
| 8,215,335 | B2 | 7/2012 | Barnham | |
| 8,302,932 | B2 | 11/2012 | Bakke et al. | |
| 8,327,474 | B2 | 12/2012 | Van Zeeland et al. | |
| 8,684,331 | B2 | 4/2014 | Spolski | |
| 8,820,346 | B2 * | 9/2014 | Corbett | F04F 10/00 137/151 |
| 9,032,866 | B2 | 5/2015 | White et al. | |
| 9,803,348 | B1 | 10/2017 | Schuster et al. | |
| 10,995,481 | B2 | 5/2021 | Veros et al. | |
| 11,022,124 | B2 | 6/2021 | Ward et al. | |
| 2013/0220440 | A1 * | 8/2013 | Corbett | F04F 10/00 137/142 |

OTHER PUBLICATIONS

"Ceramic Magnet, Magnetized Through Thickness, 1/4" Thick, 1.2 lbs. Maximum Pull", McMaster-Carr, retrieved on Apr. 26, 2022 from https://www.mcmaster.com/5738K61/.

Cai et al., "Air Accumulation in High-Lift Siphon Hoses Under the Influence of Air Dissolution and Diffusion", Journal of Zhejiang University-Science A (Applied Physics & Engineering), vol. 16, Issue 9, pp. 760-768 (2015).

"How can I get rid of air buildup in a siphon system?", Physics Forums, May 20, 2015, retrieved on May 21, 2023 from https://www.physicsforums.com/threads/how-can-i-get-rid-of-air-buildup-in-a-siphon-system.814904/.

* cited by examiner

Return to Cycling Operation from Non-Cycling Operation

Whenever the new input flow rate falls below the threshold flow rate, the siphon operation is restored to its cycling operation

FIG. 7E

APPARATUS AND METHOD FOR A CYCLE SIPHON USING A FLOAT OPERATED MAGNETICALLY CONTROLLING PIVOTING FLOAT VALVE FOR MINIMIZING THE BUILD-UP OF GASES

BACKGROUND OF THE INVENTION

The present invention relates generally to siphons and, more particularly, to an apparatus and method for an automatically cycling siphon for a drain system of a liquid containing dissolved and/or entrained gasses therein and which eliminates and/or minimizes the build-up of gas bubbles in the drain system.

The use of siphons for conveying liquids is a well-known process whereby a tube is positioned between an elevated liquid source and an exit point of the tube at a lower elevation and once the siphon is initially primed to expose the liquid to a negative pressure. Although there are an unlimited number of applications of siphons, a particular implementation of a siphon may be a drain system for removing water from residences or industrial environments that collects in the lower levels of these environments, e.g., basements.

However, one disadvantage of using a siphon in these drain systems is that during low pressure/low flows of the siphoned liquid, the siphon system tends to build up gases in the system which obstructs the overall flow, thereby diminishing the siphon's effectiveness. For example, ground water already has dissolved and/or entrained gases therein. When that ground water needs to be removed from a location it has collected in using a siphon, the low pressure, turbulence and possibly even the temperature rise within the siphon's uptake tube, all tend to pull the gases out of the water and, as a result, over time, these gases form a large gas bubble (e.g., several inches long) at the apex of the uptake tube. This gas bubble reduces the efficiency of the siphon and may even obstruct its operation.

Thus, there remains a need for a siphon system that automatically eliminates and/or minimizes the further build-up of gas bubbles in the liquid being drained in order to maintain the effectiveness of the siphon system. The subject invention addresses that need.

All references cited herein are incorporated herein by reference in their entireties.

BRIEF SUMMARY OF THE INVENTION

A siphon that automatically cycles in a drain system (DS), that is initially-primed to exhibit a negative pressure (e.g., in the range of −10 psi to −2 psi), to automatically remove a liquid (e.g., water, etc.), having dissolved and/or entrained gasses therein, collecting in a basin through a drain tube to a disposal site at a lower elevation, by minimizing a build-up of gases within the DS which obstructs operation of the DS is disclosed. The siphon comprises: a valve (e.g., a linear valve, a ball valve, etc.) in fluid communication with the drain tube; a float that floats on the liquid in the basin and controls the opening and closing of the valve, the float exhibiting a buoyancy force that increases as a liquid in the basin increases; a pair of magnets, in contact with each other by a magnetic attractive force, arranged to restrict upward movement of the float to maintain the valve completely closed until the buoyancy force exceeds the magnetic attractive force at which time the pair of magnets separate to permit the float to displace upward and fully open the valve, thereby exposing the liquid in the basin to the negative pressure to evacuate the liquid from the basin and through the drain tube to the disposal site, while allowing the float to move downward as the liquid level decreases, causing the pair of magnets to approach each other and attractively contact to completely close the valve again, thereby causing the siphon to continuously cycle as the basin again fills with liquid.

A method of forming a siphon that automatically cycles in a drain system (DS), that is initially-primed to exhibit a negative pressure, to automatically remove a liquid (e.g., water, etc.), having dissolved and/or entrained gasses therein and collecting in a basin at an input flow rate, through a drain tube to a disposal site at a lower elevation, by minimizing a build-up of gases within the DS which obstructs operation of the DS is disclosed. The method comprises: positioning a valve in fluid communication with the drain tube; providing a float that floats on the liquid in the basin and controls the opening and closing of the valve, the float exhibiting a buoyancy force that increases as a liquid level in the basin increases; arranging a pair of magnets, in contact with each other by a magnetic attractive force, to restrict upward movement of the float to maintain the valve completely closed until the buoyancy force exceeds the magnetic attractive force at which time the pair of magnets separate to permit the float to displace upward and fully open the valve, thereby exposing the liquid in the basin to the negative pressure to evacuate the liquid from the basin at an evacuation flow rate and through the drain tube to the disposal site, while allowing the float to move downward as the liquid level decreases, causing the pair of magnets to approach each other and attractively contact and completely close the valve again, thereby causing the siphon to continuously cycle, defining a cycling operation of said siphon, as the basin again fills with liquid.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 6A-6C depict an alternative embodiment of the present invention where the linear valve is replaced with a ball valve and the magnets are coaxial and wherein FIG. 6A depicts the alternative embodiment in the closed condition, FIG. 6B is a partial side view the alternative embodiment taken along line 6B-6B of FIG. 6A with a sleeve partially-shown and magnetic rings omitted, and FIG. 6C shows the alternative embodiment where the ball valve is in the open condition.

FIG. 7E is a flow diagram of how the siphon operation moves from the non-cycling operation to the cycling operation.

DETAILED DESCRIPTION OF THE PREFERRED EMBODIMENTS

Figure 1:
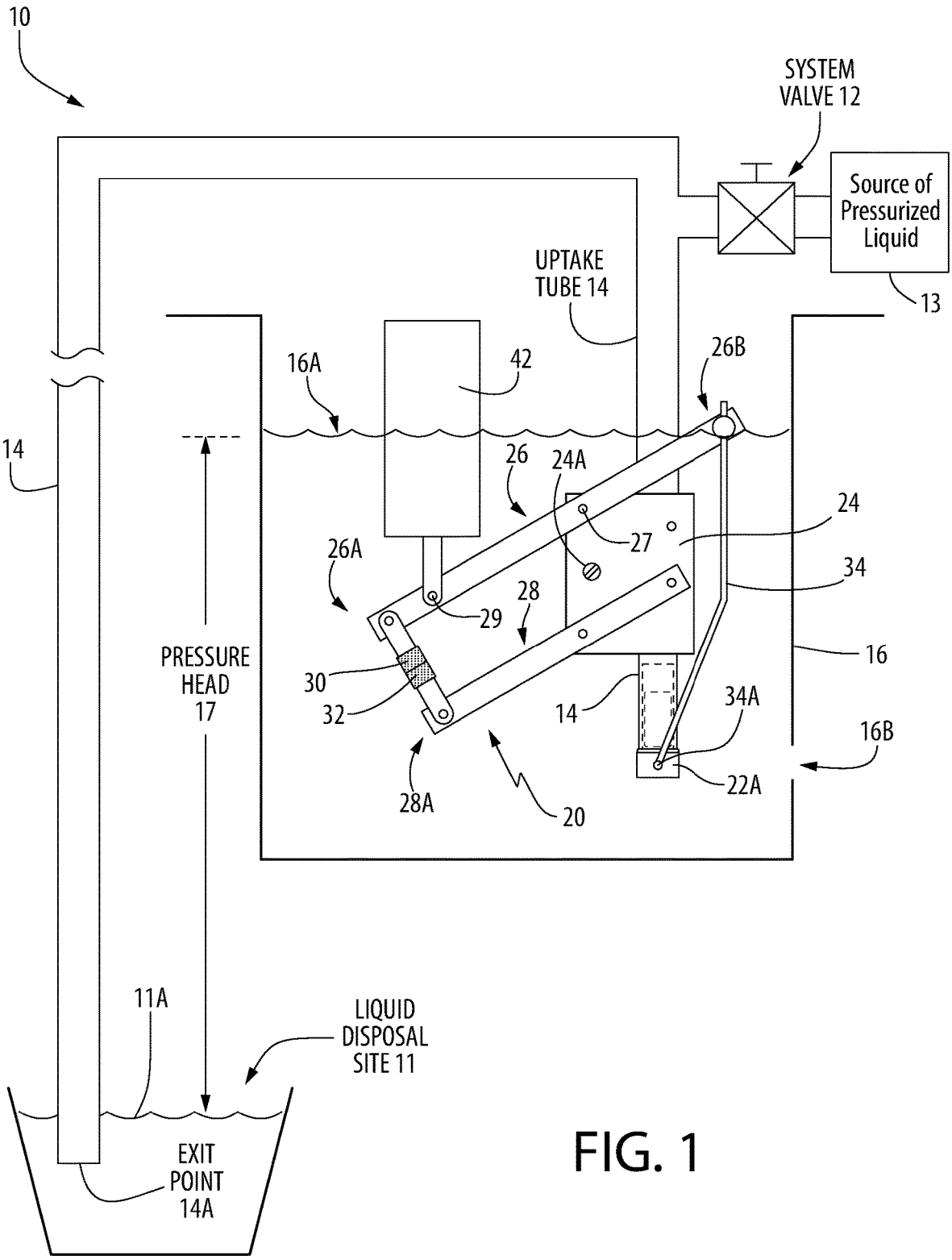
FIG. 1 is a siphon system diagram showing the present invention installed therein for preventing or minimizing the collection of entrained gases in the siphoned liquid.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

It should be understood that the following embodiments of the cycling siphon of the present invention are operable with liquids in general. Any reference to "water" in the Specification or in the Figures is made only by way of example.

Figure 2:
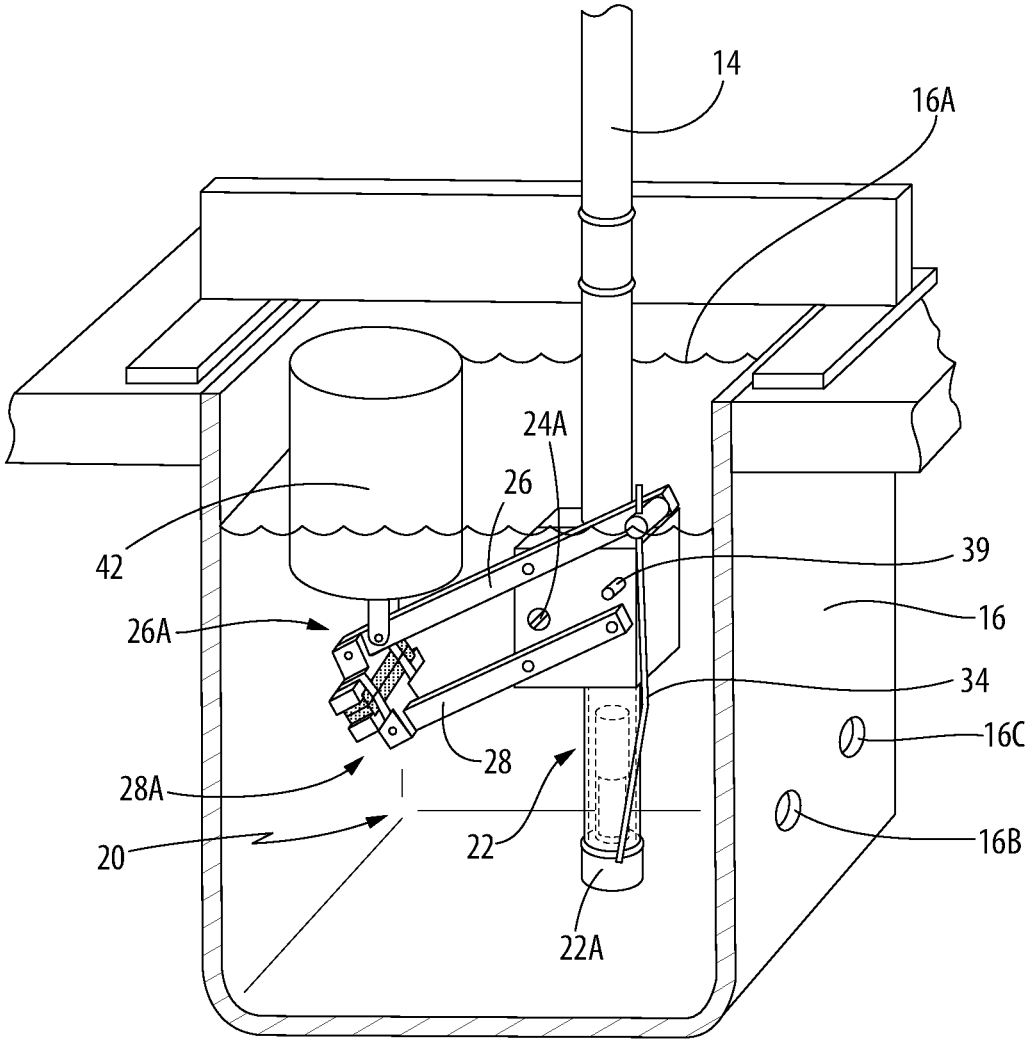
FIG. 2 is an isometric view of the present invention.

As shown most clearly in FIG. 1, the present invention is a cycling siphon (CS) 20 for use in a drain system (DS) 10, one of which is shown in FIG. 1. The DS 10 comprises a drain tube (e.g., an uptake tube) 14, one end of which is located in a collection basin 16 which collects a liquid (e.g., water) through input apertures (e.g., 16B/16C as shown in FIG. 2) in the lower region (e.g., basement, bottom floor, etc.) of a structure (e.g., a home, a business, etc.). The exit point 14A of the uptake tube 14 is located at a lower elevation, e.g., a liquid disposal site 11. The location of the exit point 14A of the uptake tube 14 is at a lower elevation which creates a "pressure head" 17, as will be discussed in detail later. The DS 10 also comprises a source of pressurized liquid 13 and a system valve 12 that is used for "priming" the DS as will also be discussed later.

However, as mentioned previously, a standard siphon configuration suffers from the build-up of gases as the siphon valve slowly opens/and closes due to float motion. For example, if liquid enters the basin 16 through the input apertures 16B/16C at a certain rate (e.g., 0.5 gallons/minute (GPM)), the float of these conventional siphons cooperates with the valve to match that rate and the conventional siphon takes up an equivalent flow at that flow rate (here, 0.5 GPM). But this "matching" of such low flow rates results in gases (e.g., air) building up in the uptake tube 14 and within a finite amount of time (e.g., 48 hours), the siphon will stop operating.

This problem is solved by the cycling siphon 20 of the present invention, as is discussed below. It is the cycling of the siphon that eliminates and/or minimizes the further build-up of bubbles in the liquid being removed.

Figure 3B:
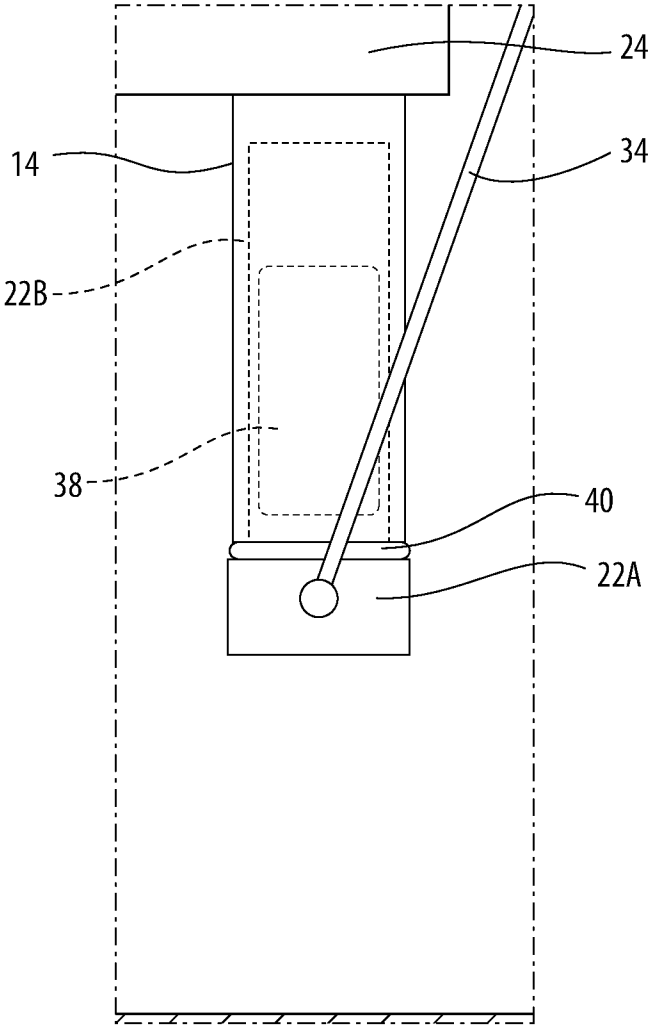
FIG. 3B is an enlarged view of the linear valve shown in the closed condition.
Figure 3A:
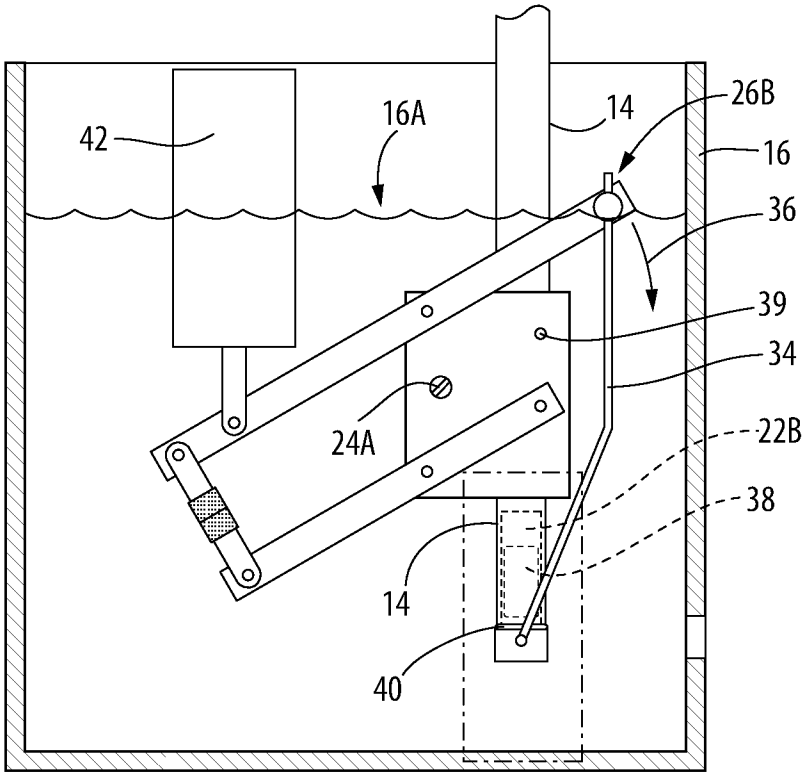
FIG. 3A is a plan view of the present invention installed in the basin, shown cross-sectionally, with the present invention shown with the linear valve in a closed condition.
Figure 4B:
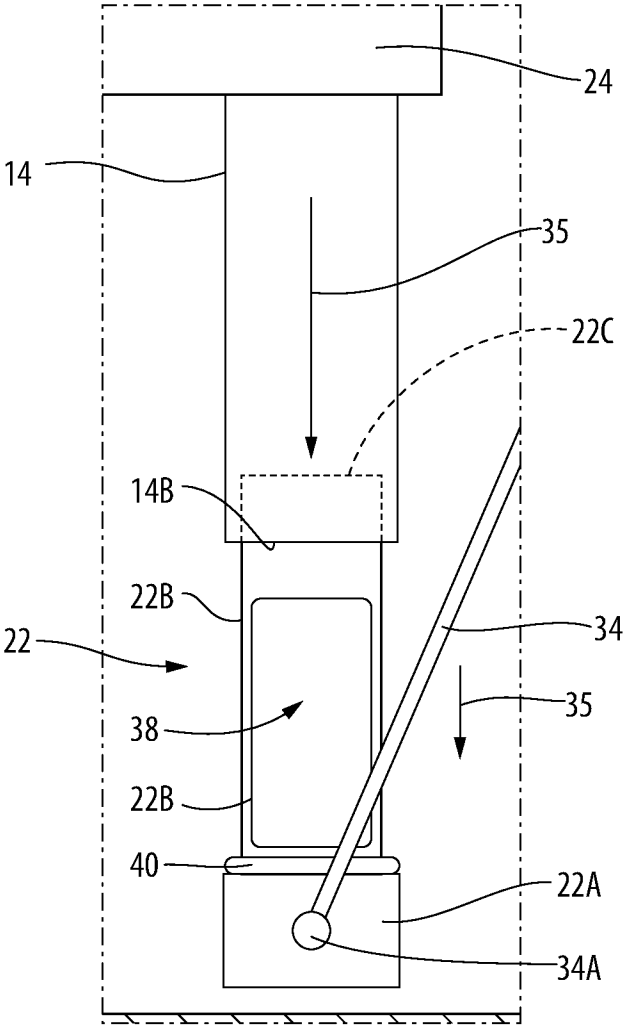
FIG. 4B is an enlarged view of the linear valve shown in the open condition.
Figure 4A:
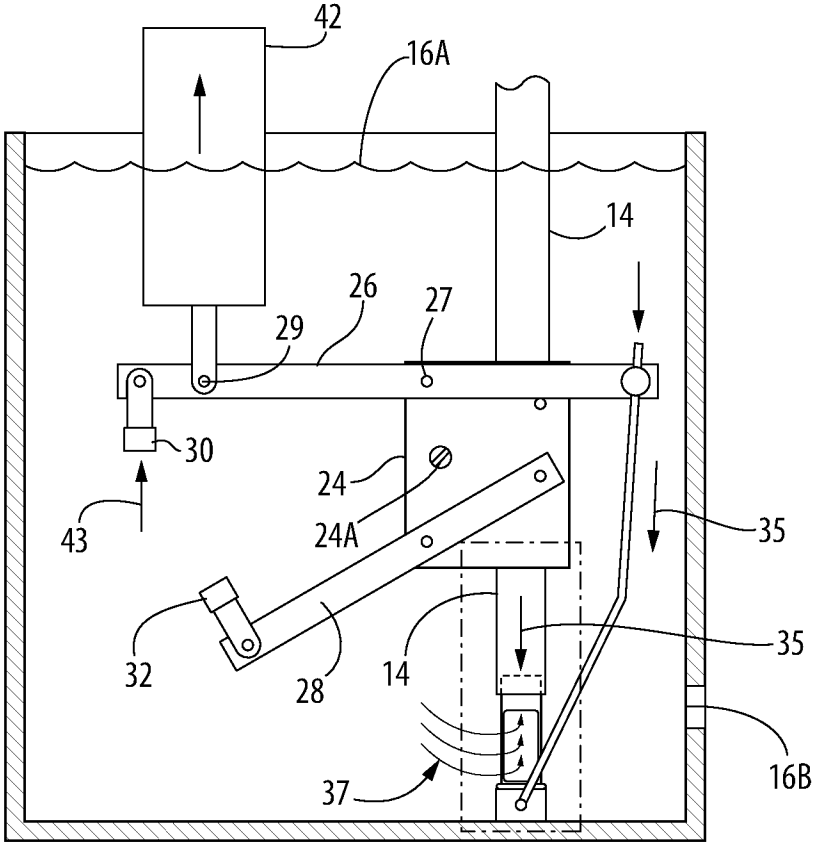
FIG. 4A is a plan view of the present invention installed in the basin, shown cross-sectionally, with the present invention shown with the linear valve in an open condition, draining the basin ofthe collected water.

The CS 20 comprises a valve 22 (e.g., a linear valve) located at the one end of the uptake tube 14 of the DS 10 that is located in the collecting basin 16. The CS 20 further comprises a mounting block 24 through which the lower portion of the uptake 14 is releasably secured. A swing arm 26 is pivotally mounted to the mounting block 24 at pivot point 27. A fixed arm 28 is fixedly mounted to the mounting block 24. As shown most clearly in FIG. 5, a respective first end 26A/28A of each arm 26/28 comprises a respective magnet 30 and 32 which attract each other together, thereby holding the swing arm 26 to the fixed arm 28. A second end 26B of the swing arm 26 comprises a drive rod 34 coupled thereto. A lower end 34A of the drive rod 34 is coupled to the lower end 22A of the valve 22 such that as the swing arm 26 pivots in a clockwise direction 36 (FIG. 3A), the drive rod 34 moves downward in the direction 35 (FIGS. 4A-4B) causing the lower end 22A, as well as the valve body 22B, to displace downward, thereby fully exposing a valve opening 38 (e.g., a rounded rectangular opening) in the valve body 22B to the water in the basin 16, thereby providing a low pressure pathway for liquid in the basin 16 to move rapidly into and up into the uptake tube 14, as shown by the arrows 37 (FIG. 4A). The top portion 22C of the valve body 22B is open so that liquid flowing into the valve opening 38 passes upward through the valve body 22B and up into the uptake tube 14. An O-ring 40 is provided on top of the lower end 22A to provide a tight seal between the lower end 22A of the valve 22 and the lower end 14B of the uptake tube 14 when the valve 22 is in the closed position (see FIG. 3B).

Furthermore, a float 42 is pivotally coupled to the swing arm 26, near the first end 26A at pivot point 29. Although the float 42 may comprise a variety of shapes or contours, a cylindrical configuration is shown by way of example only and may comprise approximately 4" in diameter×6" in height. The float 42 floats on the liquid collecting in the basin 16 and attempts to rise as the liquid level 16A rises. This increasing liquid level also increases an upward buoyancy force exhibited by the float 42. The magnetic attraction of the two magnets 30 and 32 opposes the upward buoyancy force of the float 42 and prevents the float 42 from moving upward as the liquid level 16A rises. However, once the buoyancy force exceeds the magnetic attractive force of the magnets 30/32, as well as the valve's 22 closure pressure, the float 42 is able to separate the first end 26A of the swing arm 26 away from the first end 28A of the fixed arm 28, in the direction of arrow 43 (FIG. 4A) causing the second end 26B of the swing arm 26 to move clockwise (in the direction of the arrow 36, FIG. 3A) which causes the drive arm 34 to move in the direction 35 (FIG. 4B), thereby opening the valve 22, as discussed above. Thus, the magnets 30/32 restrict upward movement of the float 42 to keep the valve completely closed until the upward buoyancy force of the float 42 overcomes the attractive force of the magnets 30/32 and which causes the magnets 30/32 to separate, thereby allowing the valve 22 to fully open and drain the basin 16. Liquid in the basin 16 then rushes into the valve opening 38 and up into the uptake tube 14 and towards the liquid disposal site 11, exiting the uptake tube 14 at its exit point 14A. It should be noted that to minimize the entry of gases at the exit point 14A, the exit point 14A is always submerged at the liquid disposal site 11. A stop 39 is provided on the mounting block 24 that prevents any further pivoting of the swing arm 26 once the float 42 is floating freely on the liquid level 16A (see FIG. 4A).

As liquid is removed out of the basin 16 through the opened valve 22 and into the uptake tube 14, the liquid level 16A falls, along with the float 42, thereby causing the first end 26A of the swing arm 26 to move towards the first end 28A of the fixed arm 28. As a result, as the magnet 30 on the first end 26A of the swing arm 26 approaches the other magnet 32 on the first end 28A of the fixed arm, the magnets 30/32 are rapidly attracted by the magnetic force and come into contact with each other. This rapid movement causes the drive rod 34 to quickly move upward and rapidly close the valve 22 by bringing the O-ring 40 into tight contact with the lower end 14B (FIG. 4B) of the uptake tube 14, completely closing the valve 22. Thus, this rapid and complete opening of the valve 22, followed by draining the basin 16 and then rapidly and completely closing the valve 22 again eliminates/minimizes the build-up of gas bubbles in the uptake tube 14. As a result, this "cycle" repeats, operating the "cycling siphon" 20 as water again enters the basin 16 through the input apertures 16B and 16C.

The complete opening of the valve 22 involves a high in-rush flow and a pressure increase of the liquid in the uptake tube 14. As a result, this rapid flow and pressure increase prevent any dissolved and/or entrained gasses in the liquid from coming out of the liquid and building-up/collecting at the apex of the uptake tube 14. Moreover, any gas bubbles that may have collected at the apex of the uptake tube 14 are flushed quickly out of the DS 10.

The One-Time Siphon Priming Process

It should be understood that a "priming" process simply involves the complete filling of the DS 10 with the liquid. As such, the one-time priming process can be achieved in any number of ways. The following is simply one example of a one-time priming process of the DS 10 with the CS 20 installed therein:

(1) The exit port 14A of the uptake tube 14 is positioned at an elevation which is lower ("disposal site" 11) than the liquid level 16A in the basin 16; this exit port 14A is maintained in a submerged state at this "disposal site" 11 to prevent any gases from entering the exit port 14A. For the next step, it should be noted that the valve 22 must remain completely closed while the system valve 12 is opened in order to force the liquid towards the disposal site 11. All that is required is that is that the uptake tube 14 be filled with liquid; this can be accomplished in many ways.

(2) The system valve 12 is opened for a predetermined amount of time (e.g., 2 minutes) to permit a pressurized source of liquid 13 (e.g., where the liquid is water, a well water source, etc.) to fill the overall system 10 with liquid;

(3) The system valve 12 is then closed which thereby creates a pressure head 17 (e.g., in the range of −10 psi to −2 psi, typically −6 psi) between the basin liquid level 16A and liquid level 11A at the disposal site 11.

Once the DS 10 is primed, the CS 20 is self-operating as it cycles between completely opening the valve 22, emptying the basin 16 of liquid and then completely closing the valve 22 and allowing liquid to again collect in the basin 16 and repeating this cycle.

Non-Cycling Mode of the CS 20

During the cycling operation of the CS 20, discussed previously, the valve 22 is completely open whereby the CS 20 evacuates the liquid from the basin 16 at a maximum evacuation flow rate (MEFR); by way of example only, the MEFR may comprise 10 GPM. As long as the input flow rate (IFR) of the liquid into the basin 16 through the apertures 16B/16C is comparatively low, by way of example only, 0.5-5 GPM, the CS 20 evacuates the liquid at the MEFR.

However, when the IFR reaches or exceeds a threshold input flow rate (TIFR), again by way of example only, 6-6.5 GPM, the CS 20 automatically switches to a non-cycling mode whereby the valve 22 operates to match this new IFR such that the CS 20 is evacuating liquid from the basin 16 at this new IFR, rather than at the MEFR. As such, when operating in the non-cycling mode, the valve 22 is never closing but rather "adjusts" or "regulates" the evacuation of the liquid in the basin 16 by matching the new IFR. This matching occurs because the float 42 oscillates as the liquid level 16A rises and falls in a limited movement such that the magnetic attractive force is insufficient to pull the magnets 30/32 together, thereby preventing the closing of the valve 22. Thus, for IFRs at or above the TIFR, these rapid flows and increased pressures are sufficiently high so as to prevent any dissolved and/or entrained gasses in the liquid from coming out of the liquid and building-up/collecting at the apex of the uptake tube 14. Moreover, any gas bubbles that may have collected at the apex of the uptake tube 14 are flushed quickly out of the DS 10. Should the IFR ever fall below the TIFR, the CS 20 automatically switches to the cycling mode at the MEFR.

Cycling Siphon 20 Components

Figure 5:
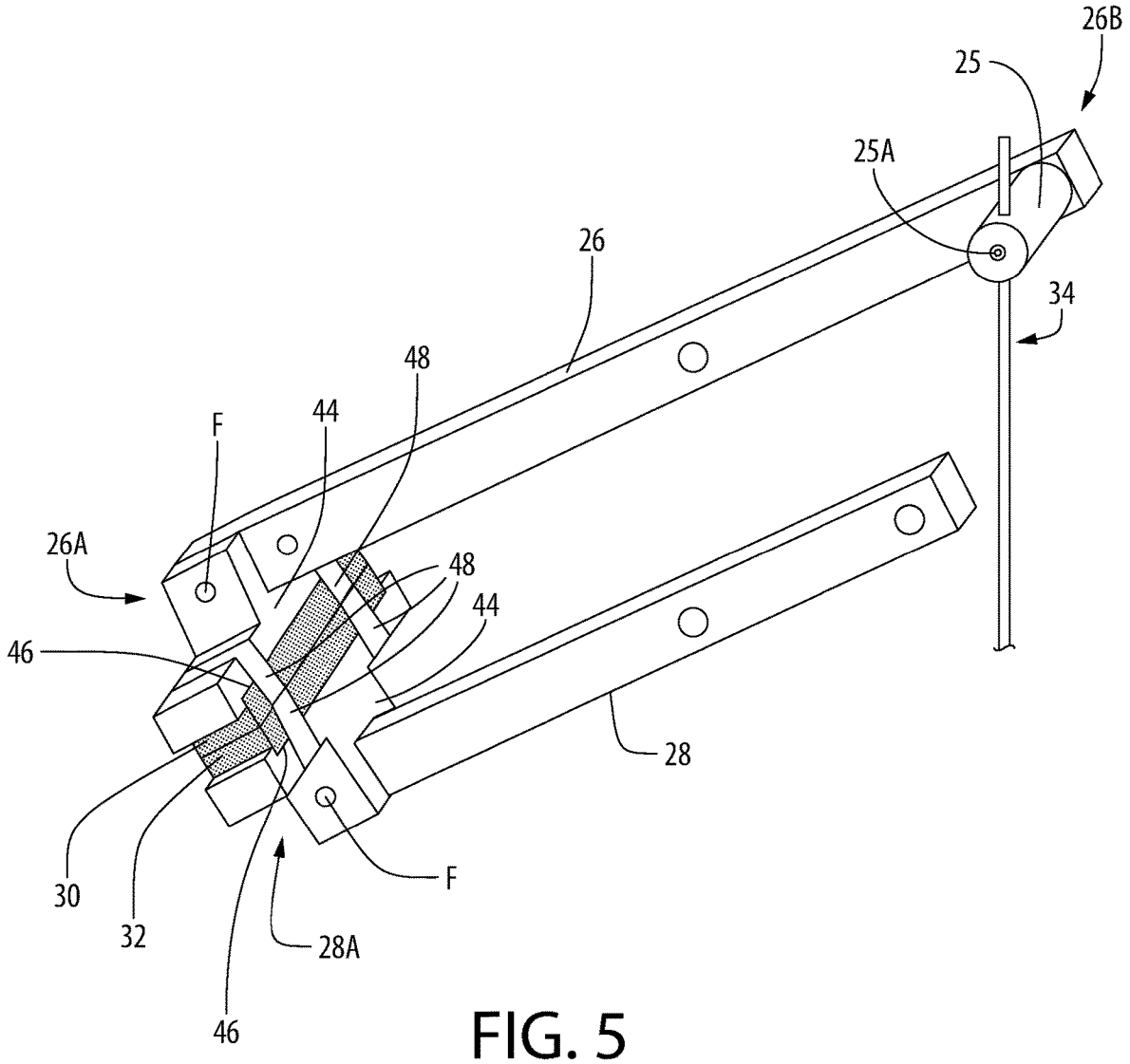
FIG. 5 is an enlarged isometric view of the swing/fixed arm of the present invention showing the magnets attractively in contact for maintaining the linear valve (not shown) in the closed condition.

The magnets 30 and 32 may comprise bar magnets (e.g., Ceramic Magnet, Magnetized Through Thickness, ¼" Thick, 1.2 lbs. Maximum Pull|McMaster-Carr, etc.). It should be noted that despite the CS 20 being submerged in a liquid (e.g., water) in the basin 16, the magnets 30 and 32 do not require being shielded from contact with the liquid; thus, where water is the liquid, the magnets 30/32 do not require being waterproofed; water has very little effect on magnetic attraction of the magnets 30 and 32. Although there are a variety of ways to secure the magnets to the first ends 26A/26B of the swing arm 26/fixed arm 28, FIG. 5 depicts 7*r*-shaped members 44 that fit over the swing arm 26 and fixed arm 28 and are secured thereto with fasteners F. The magnets 30 and 32 fit into recesses 46 of respective members 44 therein. Resilient spring clips 48 are applied over each side of the members 44 to secure the magnets 30 and 32 to their respective members 44.

Because the CS 20 is submerged in the liquid in the basin 16, the swing arm 26, fixed arm 28 and drive rod 34 preferably comprise stainless steel. The mounting block 24, π-shaped members 44, valve body 22A may comprise a durable plastic material, e.g., Delrin®. Furthermore, by way of example only, the swing arm 26 and fixed arm 28 may be 7.5" in length.

The mounting block 24 may be releasably secured to the uptake tube 14, along with adjusting the location of the mounting block 24 along the length of the uptake tube 14, using a fastener 24A. Furthermore, since the mounting block 24 location is adjustable, a means to adjust the drive rod 34 to the swing arm 26 accordingly is also provided. In particular, as shown most clearly in FIG. 5, a coupling 25 is provided for connecting the drive rod 34 to the second end 26B of the swing arm 26. A set screw 25A is provided to permit the drive rod 34 to be accordingly adjusted.

Alternative Cycling Siphon 120

Figure 6C:
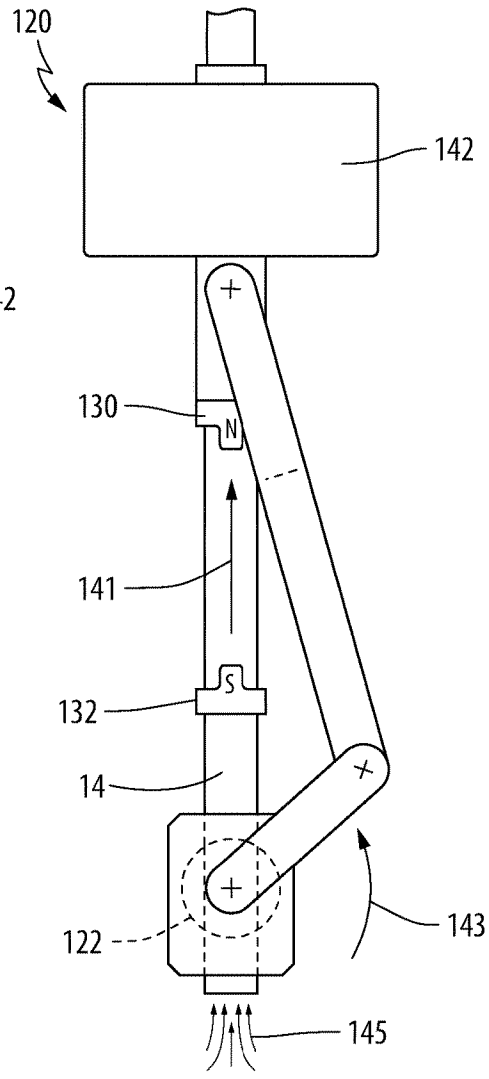
Figure 6B:
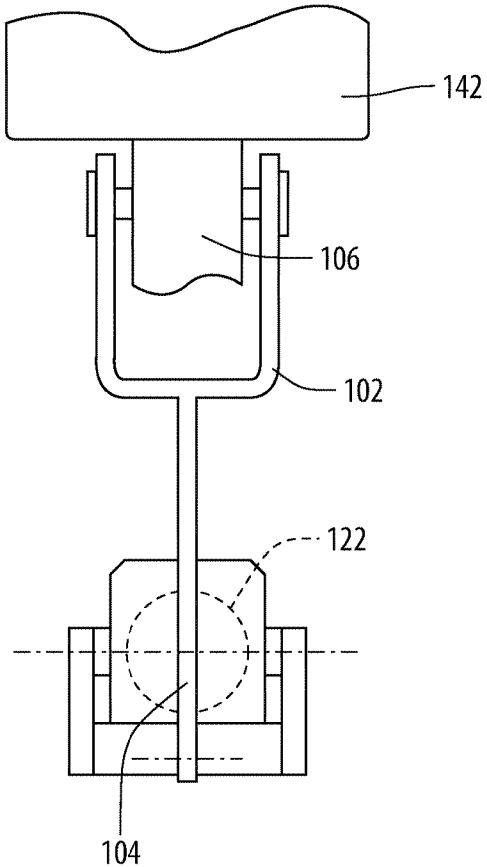
Figure 6A:
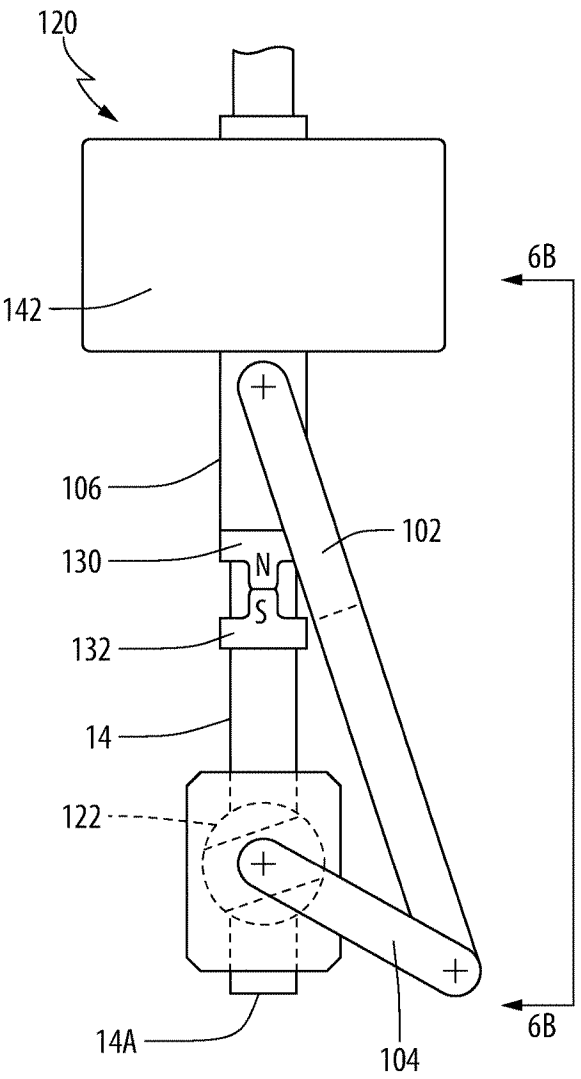
Figure 7A:
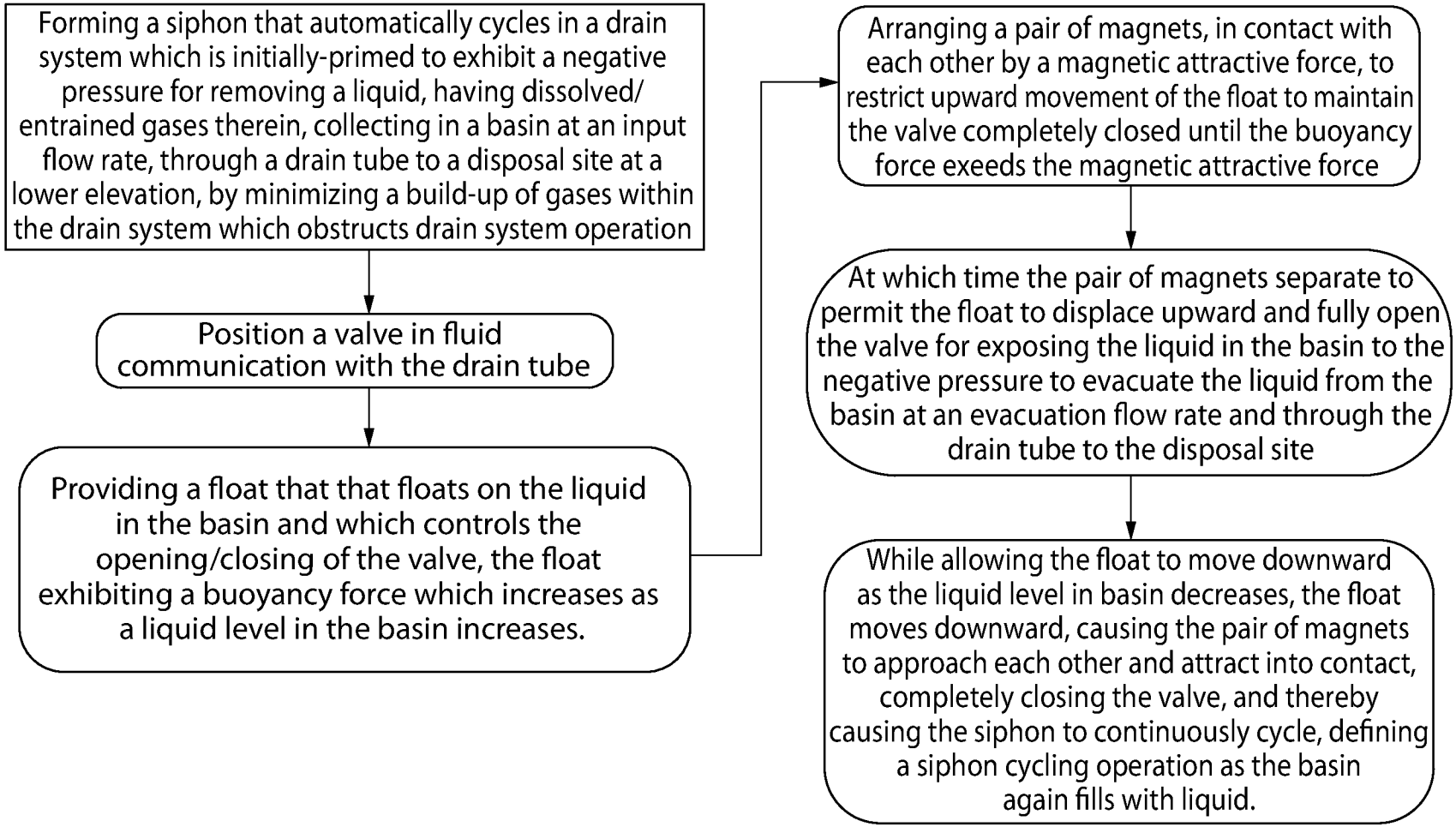
FIG. 7A is flow diagram of the method forming the siphon of the present invention.
Figure 7B:
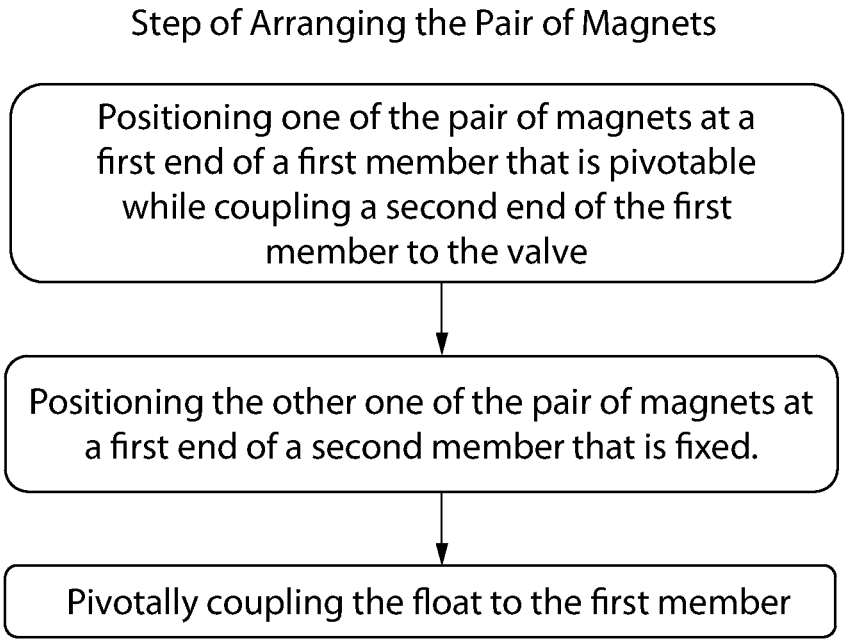
FIG. 7B is a flow diagram of the step of arranging the pair of magnets for the siphon.
Figure 7C:
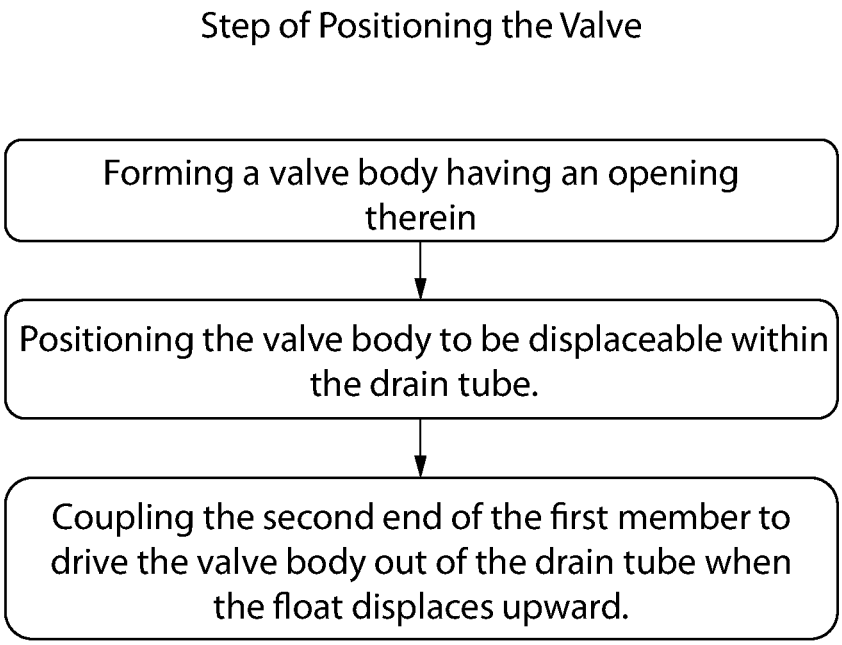
FIG. 7C is a flow diagram of the step of positioning the valve of the siphon.
Figure 7D:
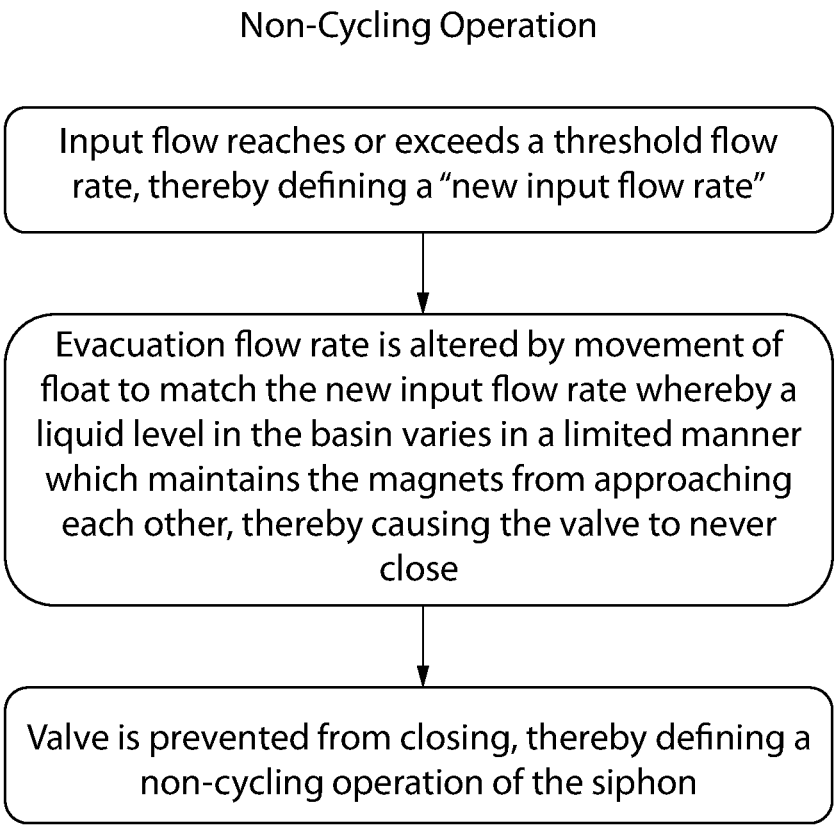
FIG. 7D is a flow diagram of the non-cycling operation of the siphon.

FIGS. 6A-6C depict an alternative cycling siphon (ACS) 120. Instead of using a swing arm 26 and a fixed arm 28, the ACS 120 comprises a pair of magnetic rings or collars 130 and 132 that are coaxial and fit over the uptake tube 14 to form a vertically stacked pair of magnets. A ball valve 122 is in fluid communication with the lower end 14A (FIG. 6A) of the uptake tube 14. The ball valve 122 is controlled by movement of a yoke 102 and pivot arm 104. As shown most clearly in FIG. 6B, the yoke 102 is journaled to a sleeve 106 that is either coupled to, or forms a part of, a float 142. Magnet 130 forms, or is otherwise coupled to, the lower end of the sleeve 106.

During operation, as liquid collects in the basin 16, the magnets 130/132 are in attractive contact with each other, thereby restricting the upward buoyant force of the float 142 as the liquid in the basin 16 collects. As shown in FIG. 6A, with the magnets 130/132 in attractive contact, the yoke 102 and pivot arm 104 maintain the ball valve 122 in a completely closed position, thereby preventing liquid in the basin 16 from entering the uptake tube 14. However, as with the CS 20, once the buoyancy force exceeds the magnetic attractive force of the magnets 130/132, as well as the ball valve's 122 closure pressure, the float 142 is able to separate the upper magnet 130 from the lower magnet 132 in the direction of the arrow 141 (FIG. 6C). The upper movement of the float 142 also causes the yoke 102 and pivot arm 104 to move upward as shown by the arrow 143 which rotates the ball valve 122 into a completely open position, thereby exposing the liquid in the basin to the negative pressure (e.g., −6 psi) in the uptake tube 14 and causing the liquid in the basin 16 to rush up into the uptake tube 14 as shown by arrows 145. As the liquid level 16A in the basin 16 decreases, the float 142 descends and as the upper magnet 130 descends, it is rapidly is placed into attractive contact with the lower magnet 132, causing the yoke 102/pivot arm 104 to displace as shown in FIG. 6A, which immediately and completely closes the ball valve 122 (FIG. 6C). The cycling repeats, as discussed with respect to the CS 20.

In all other aspects, the ACS 120 operates similarly to the CS 20, including operating in a non-cycling mode whereby the valve 122 operates to match the IR such that the ACS 120 is evacuating liquid from the basin 16 at the IFR, rather than at the MEFR. As such, when operating in the non-cycling mode, the valve 122 is not completely opening and closing but rather "adjusts" or "regulates" the evacuation of the liquid in the basin 16 by matching the IFR. As discussed with the CS 20, this matching occurs because the float 142 oscillates as the liquid level 16A rises and falls in a limited movement such that the magnetic attractive force is insufficient to pull the magnets 130/132 together, thereby preventing the complete closing of the valve 122. Thus, for IFRs at or above the TIFR, these rapid flows and increased pressures are sufficiently high so as to prevent any dissolved and/or entrained gasses in the liquid from coming out of the liquid and building-up/collecting at the apex of the uptake tube 14. Moreover, any gas bubbles that may have collected at the apex of the uptake tube 14 are flushed quickly out of the DS 10. Should the IFR ever fall below the TIFR, the ACS 120 automatically switches to the cycling mode at the MEFR.

Thus, by disallowing extended periods of relatively low flow and pressure, the CS 20/ACS 120 builds up less gas in the DS 10. Cycling works because even though the pressure is low (e.g., −6 psi.) when the valve 22/122 is closed, there is a limited amount of liquid within the siphon, so what small amount of gas may form is washed downstream at a high flow rate when the valve 22/122 opens fully.

While the invention has been described in detail and with reference to specific examples thereof, it will be apparent to one skilled in the art that various changes and modifications can be made therein without departing from the spirit and scope thereof.

What is claimed is:

1. A siphon that automatically cycles in a drain system prone to experience a built-up of gases, that is initially-primed to exhibit a negative pressure, to automatically remove a liquid, having dissolved and/or entrained gasses therein, collecting in a basin through a drain tube to a disposal site at a lower elevation, by minimizing a build-up of gases within the drain system which obstructs operation of the drain system, said siphon comprising:

a valve in fluid communication with the drain tube, the drain tube having a portion elevated above said valve, said elevated portion prone to collect the gases that were dissolved or entrained in the liquid;

a float that floats on the liquid in the basin and controls the opening and closing of said valve, said float exhibiting a buoyancy force that increases as a liquid level in the basin increases; and a pair of magnets, in contact with each other by a magnetic attractive force, arranged to restrict upward movement of said float to maintain said valve completely closed until said buoyancy force exceeds said magnetic attractive force at which time said pair of magnets separate to permit said float to displace upward and fully open said valve, thereby exposing the liquid in the basin to the negative pressure to evacuate the liquid from the basin and through the drain tube to the disposal site, while allowing said float to move downward as the liquid level decreases causing said pair of magnets to approach each other and attractively contact to completely close said valve again, and causing said siphon to continuously cycle based upon said initial priming as the basin again fills with liquid.

2. The siphon of claim 1 wherein one of said pair of magnets is positioned at a first end of a first member that is pivotable while a second end of said first member is coupled to said valve and the other one of said pair of magnets is positioned at a first end of a second member that is fixed, said float being pivotably coupled to said first member.

3. The siphon of claim 2 wherein said valve comprises a valve body having an opening therein and wherein said valve body is displaceable within the drain tube and wherein said second end of said first member drives said valve body out of the drain tube when said float displaces upward.

4. A method of forming a siphon that automatically cycles in a drain system prone to experience a built-up of gases, to automatically remove a liquid, having dissolved and/or entrained gasses therein and collecting in a basin at an input flow rate, through a drain tube to a disposal site at a lower elevation, by minimizing a build-up of gases within the drain system which obstructs operation of the drain system, said method comprising:

positioning a valve in fluid communication with the drain tube having a portion elevated above said valve, said portion being prone to collect the gases that were dissolved or entrained in the liquid;

providing a float that floats on the liquid in the basin and controls the opening and closing of said valve, said float exhibiting a buoyancy force that increases as a liquid level in the basin increases;

arranging a pair of magnets, in contact with each other by a magnetic attractive force and coupled to said valve and to said float;

utilizing a one-time priming process to establish a negative pressure with said siphon; and wherein said pair of magnets in contact with each other restrict upward movement of said float to maintain said valve completely closed until said buoyancy force exceeds said magnetic attractive force at which time said pair of magnets separate to permit said float to displace upward and fully open said valve, thereby exposing the liquid in the basin to the negative pressure to evacuate the liquid from the basin at an evacuation flow rate and through the drain tube to the disposal site, while allowing said float to move downward as the liquid level decreases, causing said pair of magnets to approach each other and attractively contact to completely close said valve again and causing said siphon to continuously cycle based upon said one-time priming process, defining a cycling operation of said siphon, as the basin again fills with liquid.

5. The method of claim 4 wherein said step of arranging said pair of magnets comprises:

positioning one of said pair of magnets at a first end of a first member that is pivotable while coupling a second end of said first member to said valve;

positioning the other one of said pair of magnets at a first end of a second member that is fixed; and pivotally coupling said float to said first member.

6. The method of claim 4 wherein said step of positioning said valve comprises:

forming a valve body having an opening therein;

positioning said valve body to be displaceable within the drain tube; and coupling said second end of said first member to drive said valve body out of the drain tube when said float displaces upward.

7. The method of claim 4 wherein whenever the input flow rate reaches or exceeds a threshold flow rate, thereby defining a new input flow rate, said evacuation flow rate is automatically altered by movement of said float to match the new input flow rate whereby a liquid level in the basin varies in a limited manner which causes said valve to never close while maintaining said magnets from approaching each other, thereby preventing said valve from closing and defining a non-cycling operation of said siphon.

8. The method of claim 7 wherein said siphon automatically switches from said non-cycling operation to said cycling operation whenever the new input flow rate decreases below the threshold flow rate.

* * * * *